US006609622B2

(12) United States Patent
Forsyth

(10) Patent No.: US 6,609,622 B2
(45) Date of Patent: Aug. 26, 2003

(54) BULLDOZER/PIPELAYER COMBINATION

(76) Inventor: Raymond Forsyth, #1904-9717 111th Street, Edmonton, AB (CA), T5K 2M6

( * ) Notice: Subject to any disclaimer, the term of this patent is extended or adjusted under 35 U.S.C. 154(b) by 0 days.

(21) Appl. No.: 09/910,996

(22) Filed: Jul. 23, 2001

(65) Prior Publication Data

US 2003/0015488 A1 Jan. 23, 2003

(51) Int. Cl.[7] ..... B66C 23/26
(52) U.S. Cl. ..... 212/258; 180/9.52
(58) Field of Search ..... 212/258; 180/9.5, 180/9.52

(56) References Cited

U.S. PATENT DOCUMENTS

| | | | | |
|---|---|---|---|---|
| 2,063,035 A | | 12/1936 | Fuller et al. | 305/9 |
| 2,495,057 A | | 1/1950 | Dillingham | 180/9.1 |
| 2,564,929 A | | 8/1951 | Shoemaker | 212/144 |
| 2,712,873 A | | 7/1955 | Peterson | 212/8 |
| 2,840,244 A | | 6/1958 | Thomas | 212/39 |
| 2,991,890 A | * | 7/1961 | Kennedy | 212/8 |
| 3,005,559 A | | 10/1961 | Toderick | 212/8 |
| 3,012,624 A | | 12/1961 | Lich | 180/9.5 |
| 3,055,511 A | | 9/1962 | Sharp | 212/8 |
| 3,329,283 A | * | 7/1967 | Wade | 212/8 |
| 3,598,347 A | | 8/1971 | Marburger | 248/2 |
| 3,785,503 A | | 1/1974 | Butterfield et al. | 212/8 |
| 3,938,669 A | | 2/1976 | Vinton | 212/8 |
| 3,990,583 A | | 11/1976 | Nishida et al. | 212/8 |
| 4,132,317 A | | 1/1979 | Arendt et al. | 212/49 |
| 4,582,153 A | | 4/1986 | Shinsen | 180/9.5 |
| 4,598,829 A | | 7/1986 | Young et al. | 212/149 |
| 4,681,205 A | | 7/1987 | Hoffmann et al. | 198/307.1 |
| 4,687,406 A | | 8/1987 | Kinsey | 414/701 |
| 4,763,742 A | | 8/1988 | Langford | 180/9.1 |
| 5,332,110 A | | 7/1994 | Forsyth | 212/258 |
| 5,348,172 A | | 9/1994 | Wilson | 212/196 |
| 5,392,936 A | | 2/1995 | Solomon et al. | 212/258 |
| 5,395,200 A | | 3/1995 | Meier | 414/281 |
| 5,518,128 A | | 5/1996 | Kröll et al. | 212/196 |
| 5,586,667 A | | 12/1996 | Landry | 212/196 |
| 5,669,517 A | | 9/1997 | Donaldson et al. | 212/196 |
| 5,685,563 A | | 11/1997 | Ottestad | 780/458 |
| 5,799,806 A | | 9/1998 | Cullity | 212/196 |

FOREIGN PATENT DOCUMENTS

| | | | |
|---|---|---|---|
| DE | 41 42 270 A 1 | 12/1991 | B66C/9/10 |
| GB | 1186447 | 4/1967 | |
| GB | 2 100 208 A | 12/1982 | |
| IT | 595268 | 9/1959 | |

OTHER PUBLICATIONS

Midwestern Brochure CAT D4H, Crane with Sidebooms.
Midwestern Brochure—Midwestern s 450000, Hydraulic Pipelayer.
Caterpillar Brochure—561D Pipelayer, Pipelayer.

* cited by examiner

*Primary Examiner*—Thomas J. Brahan
(74) *Attorney, Agent, or Firm*—Emrich & Dithmar

(57) ABSTRACT

A combination bulldozer and pipelayer includes a front mounted blade, or scoop, and a side mounted pipelayer attachment. When operated as a bulldozer, a pair of endless track roller frames are free to oscillate up and down about a horizontal axis passing through the bulldozer's main frame for improved traction and grading characteristics, reduced stress on the tractor structure, and a more comfortable ride for the operator. When operated in the pipelayer mode, the track roller frames are locked in fixed position to the vehicle's main frame to provide a stable platform for lifting and transporting a heavy load such as sections of pipe. The side mounted pipelayer attachment includes a folding boom which can be stowed in a retracted position or extended to the use position by the operator using only the boom and load controls. The bulldozer's hydraulic system is connected in series to the pipelayer's hydraulic system to permit operation of the pipelayer boom and load winches at the same speed for improved load control without stalling the heavier loaded winch drum. Also provided is a quick load release arrangement for allowing a load to free-fall to the ground in the event of an unstable condition in lifting the load.

8 Claims, 9 Drawing Sheets

BULLDOZER/PIPELAYER COMBINATION

FIELD OF THE INVENTION

This invention relates generally to apparatus attached to a tracked vehicle for lifting, transporting and laying pipe and is particularly directed to a bulldozer/pipelayer combination having a folding boom and a pair of track roller frames which oscillate when operated in the bulldozer mode and are locked in a fixed orientation when the apparatus is used in pipelaying.

BACKGROUND OF THE INVENTION

A common approach for laying pipe employs a diesel powered tracked vehicle having a side boom for lifting, transporting and positioning the pipe in or on the ground. The tractor, which frequently is in the form of a bulldozer, includes a primary closed, pressurized hydraulic system for bulldozer operation and a secondary hydraulic system coupled to the first primary system for pipelayer control. The tractor travels generally parallel with the pipeline, with its offset position from the pipeline determined by operating conditions and the size and characteristics of its side boom.

The typical bulldozer includes a front blade or scoop for moving soil or heavy objects and a pair of side-mounted track roller frames each supporting a respective endless track for propelling the bulldozer. The track roller frames are attached to the bulldozer's main frame in a pivoting manner which allows the track roller frames to oscillate up and down about a horizontal axis passing through the main frame. The vertical displacement of the forward and aft portions of each of the track roller frames as the bulldozer traverses irregular terrain provides better traction and grading characteristics, as well as a more comfortable ride for the operator. When a pipelayer is attached to the bulldozer and used in the laying of pipe, the vehicle's main frame is positioned to the side of the pipe which is maneuvered into position as the vehicle moves forward. In a conventional pipelayer, the track roller frames are rigidly attached to the vehicle's main frame and are not free to pivot in an oscillating manner. This provides the pipelayer attachment with a more stable platform for lifting and transporting heavy loads, but limits the use of the tracked vehicle as a bulldozer because the track roller frames are locked in a fixed position on the vehicle's main frame.

A pipelayer attachment typically includes a boom structure pivotally attached to one of the track roller frames of the tracked vehicle and extending to one side of the vehicle. A boom and load winch combination allows the boom structure and a load supported by the boom structure to be raised or lowered. When retracted for transport or storage, the boom structure assumes a generally vertical orientation and extends well above the height of the tracked vehicle. This limits where the tracked vehicle may be transported and stored. In order to avoid this problem, the boom structure is sometimes removed from the tracked vehicle frame for transport and/or storage, but this removal and subsequent reattachment is cumbersome, time consuming and requires several workers. In addition, when the tracked vehicle is used as a bulldozer, the retracted or upraised boom structure limits where the bulldozer can be operated.

The present invention addresses the aforementioned limitations of the prior art by providing a bulldozer/pipelayer combination incorporating a folding boom structure which can be extended for use or retracted for transport, storage or when bulldozing to a compact configuration disposed in closely spaced relation to the tracked vehicle by the vehicle operator using pipelayer boom and load controls. The bulldozer's oscillating track roller frames are automatically locked in fixed position on the vehicle's main frame for use in the pipelaying mode by the operator.

OBJECTS AND SUMMARY OF THE INVENTION

Accordingly, it is an object of the present invention to provide a bulldozer/pipelayer combination that is equally adapted for grading and earth moving as well as for lifting and transporting heavy loads when used in pipelaying.

It is another object of the present invention to provide in a bulldozer with a pipelayer attachment a selectable control for allowing the bulldozer's track roller frames to oscillate up and down when used as a bulldozer, or for locking the track roller frames in fixed position when operated in the pipelayer mode to provide a stable platform for lifting and transporting heavy loads.

Yet another object of the present invention is to provide a folding boom for a pipelayer attached to a tracked vehicle which can be moved between a folded and an extended position by the vehicle operator using controls employed in the operation of the pipelayer.

A further object of the present invention is to provide a folding pipelayer boom attached to the side of a tracked vehicle which when retracted allows the tracked vehicle to operate in low, narrow areas and permits tracked vehicle transport and storage without removing the boom.

A still further object of the present invention is to provide improved load control in a pipelayer attached to a tracked vehicle such as a bulldozer by rendering the pipelayer's boom and load winches equally responsive to hydraulic control inputs.

This invention contemplates a bulldozer/pipelayer apparatus comprising a main frame incorporating an engine for driving the bulldozer/pipelayer combination; first and second track roller frames each coupled to a respective lateral portion of the main frame and including a respective segmented, endless track for displacing the apparatus; a boom winch having a boom cable dispose thereabout and a load winch having a load cable disposed thereabout; and a folding boom having first and second frames pivotally coupled together, wherein the first frame is pivotally coupled to the first track roller frame and the second frame is coupled to the boom cable for raising and lowering the boom and is further coupled to the load cable for raising and lowering a load, and wherein the boom is adapted for movement between an extended, use configuration for raising and lowering a load wherein the first and second frame are in generally linear alignment and a folded configuration for storage or transport wherein the first and second frames are aligned generally transverse and are each disposed in closely spaced relation to a side of the apparatus.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
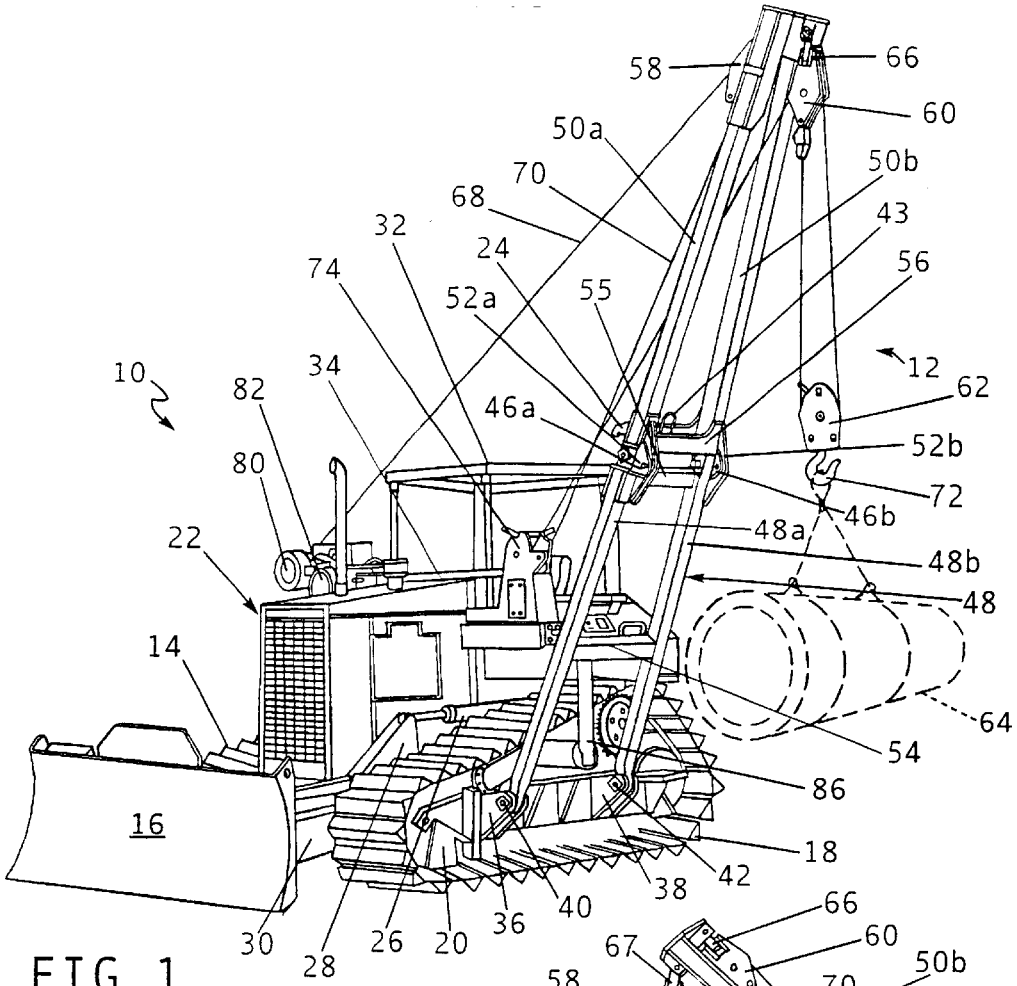
FIG. 1 is a perspective view of a bulldozer/pipelayer combination in accordance with the principles of the present invention showing the pipelayer boom in the extended position.

Referring to FIG. 1, there is shown a perspective view of a bulldozer/pipelayer combination 10 having a pipelayer attachment 12 in accordance with the present invention. The bulldozer/pipelayer combination 10 of the present invention includes a conventional tractor having a main frame 22 and left and a right track frames, where the left track frame is shown as element 20 in FIG. 1. The designations "right" and "left" are taken with the bulldozer/pipelayer combination 10 viewed from the rear. Disposed on the right and left track frames are respective right and left segmented, endless tracks 14 and 18. The tractor includes an engine, which is typically of the diesel type, in its main frame 22 and further includes a blade 16 attached to the main frame by means of left and right mechanical linkages, where the left mechanical linkage is shown as element 30 in FIG. 1. Mechanical linkage 30 is coupled to a left hydraulic cylinder 26 by means of left pivot bracket 28. A similar hydraulic cylinder, pivot bracket and mechanical linkage combination is disposed on the right side of the main frame 22 and is also connected to blade 16, although this is not shown in the figure for simplicity. Blade 16 is raised or lowered by the pair of hydraulic cylinders for displacing soil or heavy objects. The hydraulic cylinders are energized by the tractor's hydraulic system. A tractor having a movable blade 16 as shown in FIG. 1 is commonly known as a bulldozer. An operator of the bulldozer/pipelayer combination 10 sits on an upper, aft portion of the main frame 22 beneath a cover or canopy 32.

Attached to the left track frame is a pipelayer attachment 12 which includes the generally "A" shaped boom 48. Boom 48 includes first and second lower frame members 48*a* and 48*b* and first and second upper frame members 50*a* and 50*b*. Respective lower ends of the first and second boom lower frame members 48*a*,48*b* are connected to forward and aft track frame brackets 36 and 38. The forward and aft brackets 36,38 are attached to the tractor's left track frame 20, with each bracket including a pair of aligned apertures. Inserted through the aligned apertures of the forward bracket 36 and through an aperture in a lower end of the first boom lower frame member 48*a* is a first boom pivot pin 40. Similarly, inserted through the aligned apertures of the aft bracket 38 as well as through an aperture in the lower end of the second boom lower frame member 48*b* is a second boom pivot pin 42. The first and second pivot pins 40,42 allow the boom 48 to be raised and lowered in a pivoting manner as described below. Boom 48 in FIG. 1 is shown in a substantially, although not fully, upraised position. Lower and upper cross members 54 and 55 are disposed between and attached to the first and second boom lower frame members 48*a*,48*b* for increased strength and rigidity.

Figure 2:
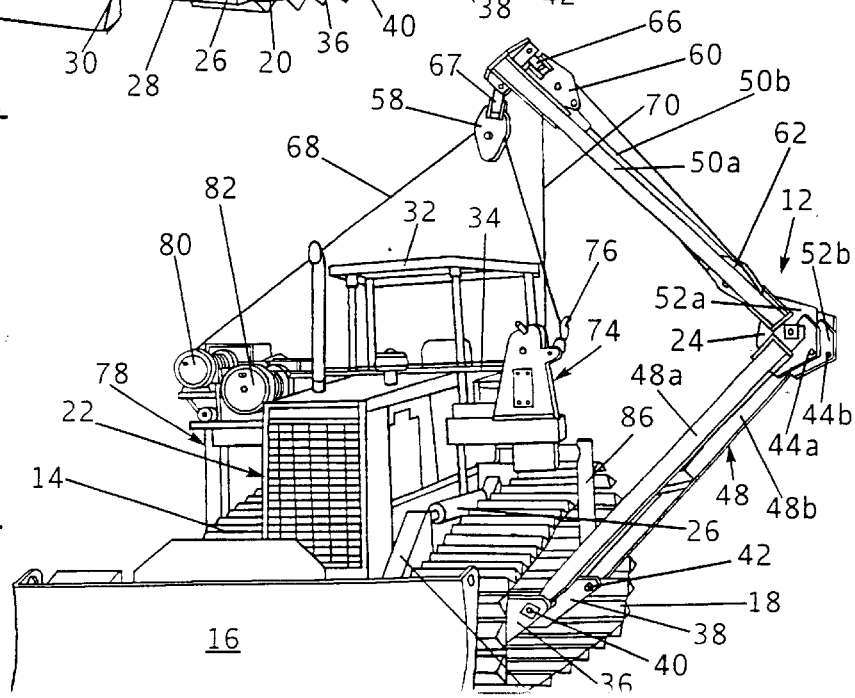
FIG. 2 is a perspective view of the inventive bulldozer/pipelayer combination showing the pipelayer boom partially retracted or folded.

Attached to the respective upper ends of the first and second boom lower frame members 48*a*,48*b* are the first and second boom upper frame members 50*a* and 50*b*. The first upper and lower frame members 48*a*,50*a* are pivotally coupled together by means of a first hinge 52*a*. Similarly, the second lower and upper frame members 48*b*,50*b* are pivotally connected together by means of a second hinge 52*b*. One or more cross members 56 are connected between the first and second hinges 52*a*,52*b* adjacent the lower ends of the first and second upper frame members 50*a*,50*b* for increased strength and rigidity. The first and second hinges 52*a*,52*b* allow the upper and lower sections of the boom 48 to pivot relative to one another as shown in the perspective view of FIG. 2 illustrating the boom in a partially folded configuration.

When the upper and lower frame members of the boom 48 are aligned and the boom is fully extended as shown in FIG. 1, aligned apertures in the first and second hinges 52*a*,52*b* are adapted to receive respective first and second boom elbow locking pins 46*a* and 46*b* for securely locking the boom in the extended configuration. In order to fold the boom 48, the first and second locking pins 46*a*,46*b* must first be removed from the aligned apertures in the first and second hinges 52*a*,52*b*. One of these aligned apertures in the first hinge 52*a* is shown as element 44*a*, while one of the apertures in the second hinge 52*b* is shown as element 44*b* in FIG. 2. In FIG. 2, the locking pins have been removed from the aligned apertures in the hinges to allow the boom to fold as shown in this figure. A pair of pivot stops are attached to the lower ends of the first and second upper frame members 50*a*,50*b* to limit the extent of folding of the upper and lower boom sections. One of these pivot stops is shown in FIG. 1 as element 24 mounted to the lower end of the first boom upper frame member 50*a* for engaging the first hinge 52*a* in limiting pivoting displacement of the boom's upper frame on its lower frame. Also attached to the lower end of the boom's upper frame is a stowing bracket 43 which is used in folding the boom 48 as described in detail below for transport or storage of the bulldozer/pipelayer combination 10. Attached to the distal, or upper, end of boom 48 is a first trunion 66. Attached to the first trunion 66 is a load block 60. Also attached to the distal end of the boom 48 is a second trunion 67. Attached to the second trunion 67 is a boom block 58. The first and second trunions 66,67 allow the load and boom blocks 60,58, respectively, to move inward and outward and also to pivot about a vertical axis passing through each block. Suspended from the load block 60 by means of a cable is the combination of a hook block 62 and a hook 72. Attached to and suspended from the hook 72 is a load 64 shown in dotted line form.

Figure 4:
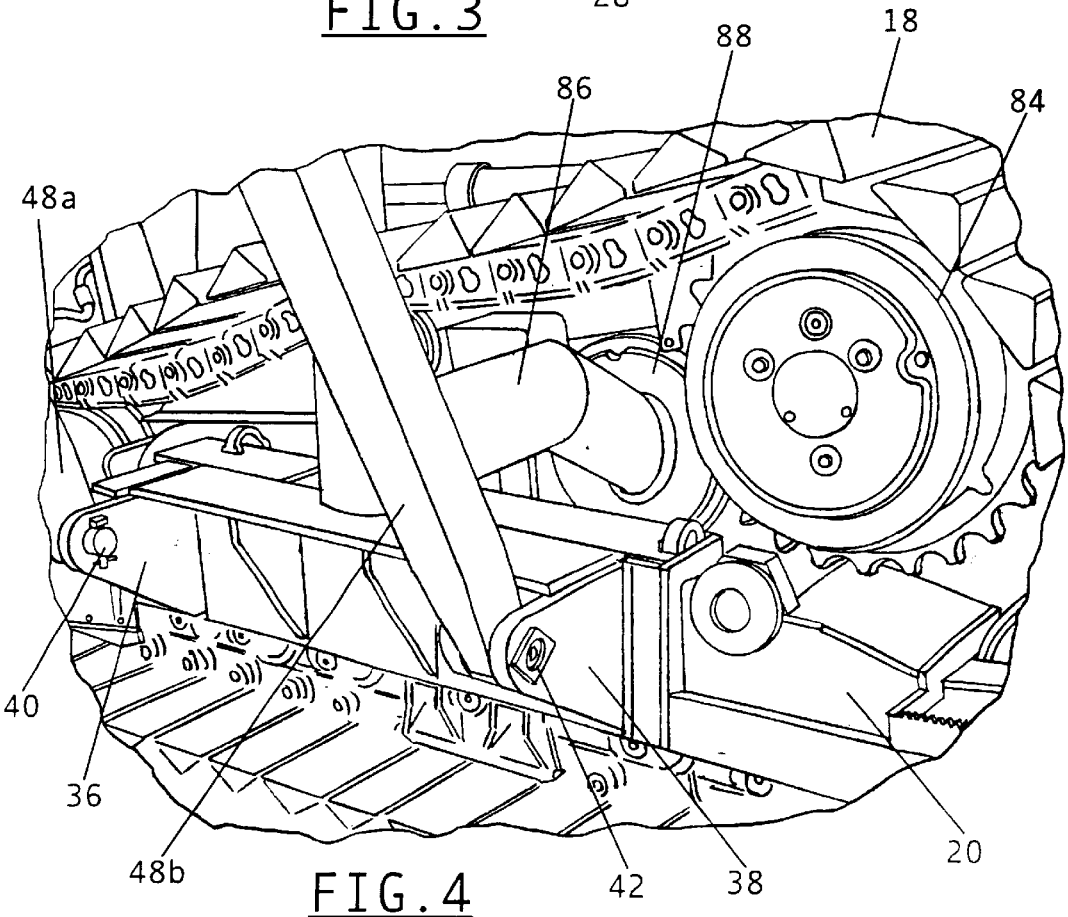
FIG. 4 is a partial perspective view of the side of the bulldozer/pipelayer combination of the present invention illustrating details of the manner in which the pipelayer's boom is connected to one of the vehicle's endless track roller frames and the manner in which the pipelayer's left support structure is attached to the vehicle's main frame independent of the track frame.

Attached to respective sides of the tractor's main frame 22 are left and right support frames 74 and 78. The left and right support frames 74,78 are attached to respective sides of the main frame 22. The left support frame 74 is attached to the left side of the main frame 22 by means of the combination of a support arm 86 and a mounting flange 88 as shown in FIG. 4. The lower end of support arm 86 is secured to mounting flange 88 such as by welding. Mounting flange 88, in turn, is securely mounted to the left side of the main frame 22. The left and right support frames 74,78 are also connected together by means of a cross member 34 disposed above and extending across the tractor's main frame 22. The left and right support frames 74,78 are thus connected to and supported only by the tractor's main frame and not by the left and right track frames as well as by the main frame as in prior approaches. Attaching the support frames to the tractor's track frames as well as to its main frame as in the prior art resulted in movement of the support frames as the track frames pivoted when in a bulldozer mode of operation. This arrangement produced unwanted displacement of the support frames and pipelayer components attached thereto and damaged the support frames.

Attached to and supported by the right support frame 78 are boom and load winches 80 and 82. Disposed about the boom winch 80 is a boom cable 68 which is inserted through the boom block 58. An end of the boom cable 68 is securely attached to the left support frame 74 by means of a cable terminator 76. The boom 48 of the pipelayer attachment 12 is raised by rotation of the boom winch 80 in a first direction so as to retract the boom cable 68. Rotation of the boom winch 80 in a second, opposed direction allows for lowering of the boom 48. A load cable 70 is disposed on the load winch 82. The load cable 70 extends from the load winch 82 above the main frame 22 to a pulley (not shown) in the left support frame 74 and then through the load block 60 to the hook block 62. Rotation of the load winch 82 in a first direction so as to retract the load cable 70 causes the load 64 to be raised. Rotation of the load winch 82 in a second, opposed direction allows the load cable 70 to be withdrawn from the winch and the load 64 to be lowered.

Figure 3:
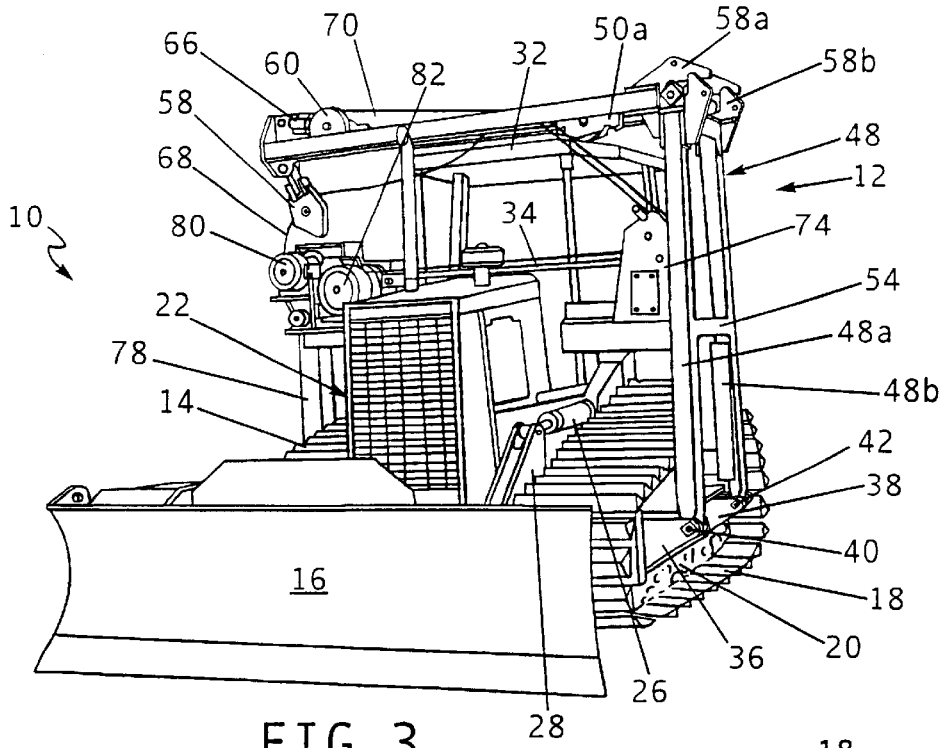
FIG. 3 is a perspective view of the inventive bulldozer/pipelayer combination showing the pipelayer boom in the fully retracted or folded position.

The procedure followed in folding the boom 48 of the pipelayer attachment 12 from the extended configuration shown in FIG. 1 to the folded configuration shown in FIG. 3 is as follows. The extended boom 48 is first lowered to an approximately horizontal position. The lower boom section including the first and second boom lower frame members **48*a*,48*b* is then supported by either attaching a chain between cross member 54 and the left support frame 74 or by positioning a block on the ground beneath the lower boom section. Slack is then provided in the boom and load cables 68 and 70. The first and second boom elbow locking pins 46*a*,46*b* are then removed from the respective apertures 44*a* and 44*b* in the first and second hinges 52*a*,52*b*. The locking pins are then stored in stowing holes (not shown for simplicity) in the lower boom section adjacent cross member 55. The boom 48 is initially folded using only the boom winch 80. When the upper boom section including the first and second upper frame members 50*a*,50*b* forms an angle of approximately 90° with the lower boom section including the first and second lower frame members 48*a*,48*b*, the hook 72 on the hook block 62 is attached to the stowing bracket 43 adjacent the lower end of the upper boom section. This is shown in FIG. 2 where the upper boom section is oriented generally 90° to the lower boom section and the combination hook and hook block 62 is attached to the stowing bracket (which is not shown in the figure for simplicity). During initial folding of the boom as the boom approaches the position shown in FIG. 2, the boom and load cables 68,70 are simultaneously retracted. As the boom 48 continues to fold, the lower boom frame pivots about the first and second pins 40 and 42 respectively inserted through the forward and aft brackets 36 and 38. Continued winding of the boom cable 68 onto the boom winch 80 proceeds simultaneously with continued paying out of the load cable 70 from the load winch 82 to avoid placing stress on the boom as it is folded. Once the boom 12 reaches the position shown in FIG. 2, the load cable 70 is paid out at the same rate that the boom cable 68 is retracted to permit the load cable to support and prevent the boom from falling as the boom approaches the fully folded position. Again, sufficient slack is provided in the load cable 70 during folding of the boom 48 to allow the load cable to follow the folding boom as the boom passes its position as shown in FIG. 2. Once the boom 48 is in the fully folded position as shown in FIG. 3, the distal end of the upper frame of the boom may be secured to the right support frame 78** by means of a chain which is not shown in the figure for simplicity. Sufficient slack must be provided for in the chain to allow for vertical oscillation of the left track roller frame as the bulldozer/pipelayer combination is used in the bulldozer mode.

The boom 48 is moved from the fully folded position shown in FIG. 3 to an extended position as shown in FIG. 1 using the following procedure. First, a support or block (not shown in the figures for simplicity) is positioned on the ground adjacent the left side of the bulldozer/pipelayer combination 10. Alternatively, a chain (also not shown in the figures) may be attached to the left support frame 74. If a stowing chain is connected between the upper end of the boom 48 and the right support frame 78, this chain is removed. The boom 48 is unfolded initially using the load winch 82. The load cable 70 is drawn onto the load winch 82 while the boom cable 68 is paid off of the boom winch 80, maintaining sufficient slack in the boom cable so that it closely follows the unfolding boom 48. After the upper folded boom section goes over center under the influence of the retracted load cable 70, the boom cable 68 will support the folded boom as shown in FIG. 2. To further unfold the boom 48, the boom cable 68 is slowly paid off of the boom winch 80 allowing the folded boom to be pulled downwardly under the influence of gravity. The load cable 70 is simultaneously allowed to pay off of the load winch 82 so that the load cable slowly follows the unfolding boom. The boom 48 is allowed to continue to unfold until the lower boom section rests upon the aforementioned support block or is supported by a chain attached to the left support frame 74, followed by alignment of the boom's upper section with its lower section, with the extended boom then assuming a generally horizontal orientation. The first and second boom elbow locking pins **46*a* and 46*b* are then respectively inserted in apertures 44*a* and 44*b* in the first and second hinges 52*a* and 52*b* to lock the boom's upper and lower sections in rigid connection. The boom 48 may then be raised by drawing the boom cable 68 onto the boom winch 80**.

Figure 5:
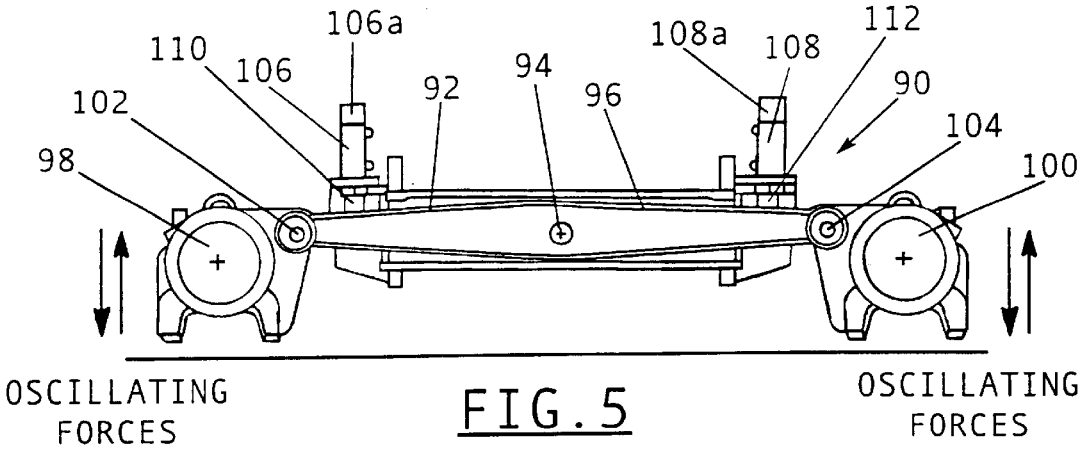
FIG. 5 is a simplified sectional view of an arrangement for preventing the vehicle's track roller frames from oscillating when used in a pipelaying mode in accordance with one aspect of the present invention.
Figure 6:
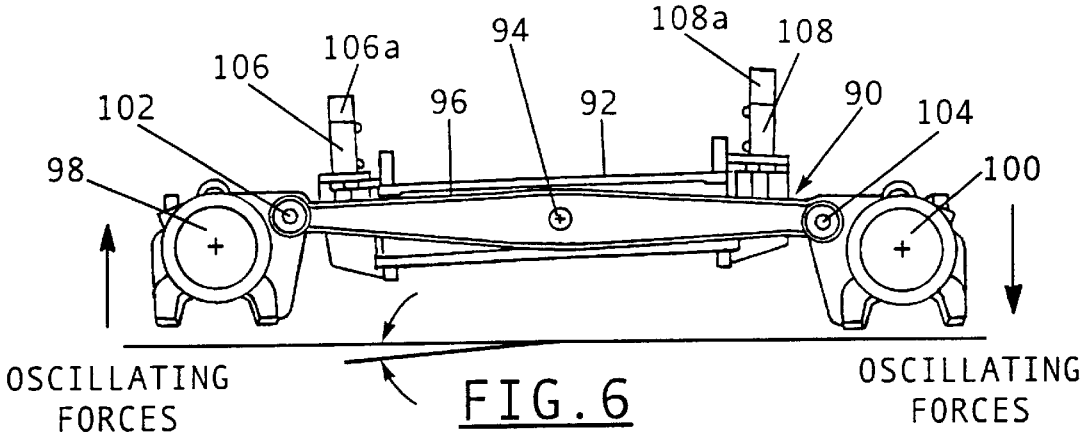
FIGS. 6 and 7 are simplified sectional views of the track roller frame mounting arrangement of the present invention showing the track roller frames free to oscillate relative to the vehicle's main frame when the vehicle is used as a bulldozer by means of an equalizer bar in accordance with another aspect of the present invention.
Figure 7:
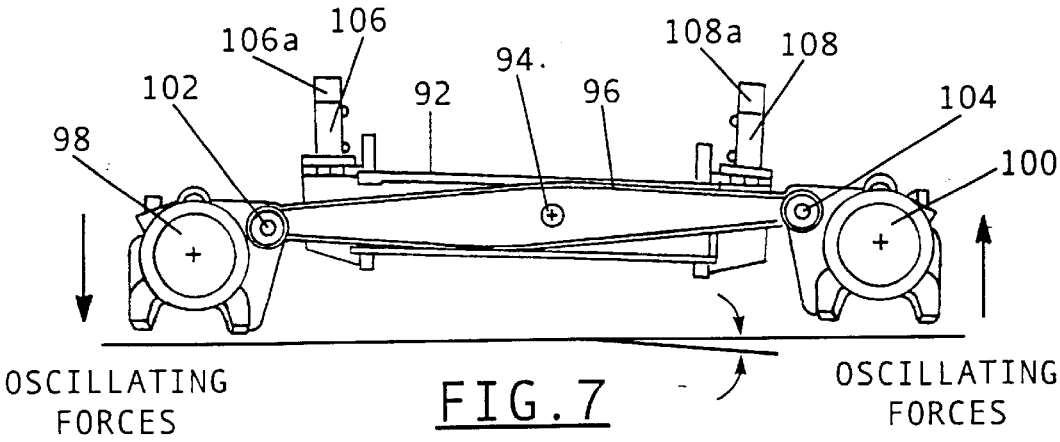

Another aspect of the present invention involving the side-mounted track frames of the bulldozer/pipelayer combination will now be described with respect to FIGS. 5, 6 and 7 which are simplified sectional views of a track frame installation in accordance with this aspect of the present invention. These figures show the inventive track frame arrangement 90 which includes an elongated equalizer bar 96 attached to a lower portion of the tractor's main frame 92 by means of a pivot pin 94. The equalizer bar 96 is oriented lengthwise transverse to the longitudinal axis of the tractor's main frame and to the direction of travel of the tractor. Pivot pin 94 allows the equalizer bar 96 to be pivotally displaced with respect to the tractor's main frame 92. Mounted to a first end of the equalizer bar 96 by means of a first equalizer bar pivot pin 102 is a first track roller frame 98. Attached to a second, opposed end of the equalizer bar 96 by means of a second equalizer bar pivot pin 104 is a second track roller frame 100. The first and second track roller frames 98,100 are disposed adjacent respective sides of the tractor's main frame 92 and are aligned lengthwise along the tractor's direction of travel. Each of the track roller frames engages and supports a segmented, endless track such as those shown in FIGS. 1, 2 and 3 for propelling the tractor. The first and second track roller frames 98,100 are free to pivot with respect to the equalizer bar 96, while the equalizer bar 96 is free to pivot relative to the tractor's main frame 92. Pivoting displacement of the equalizer bar 96 and track roller frames 98,100 allows the tractor to traverse irregular terrain while allowing the tractor's main frame 92 to remain in a generally upright, or vertical, orientation. Pivoting displacement of the equalizer bar 96 and track frames and segmented, endless tracks connected thereto provides better traction and grading characteristics as well as a more comfortable ride for the operator when used in a bulldozing mode of operation. The equalizer bar 96 and pivot pin 102,104 combination also transmits ground impact loads on the track roller frames directly to the tractor's main frame 92, protects power train components, and maintains the track roller frames in proper alignment. This mode of operation is shown in FIGS. 6 and 7 where oscillating forces are shown applied to the first and second track roller frames 98,100 causing the equalizer bar 96 to oscillate in a vertical plane relative to the tractor's main frame 92.

Figure 8:
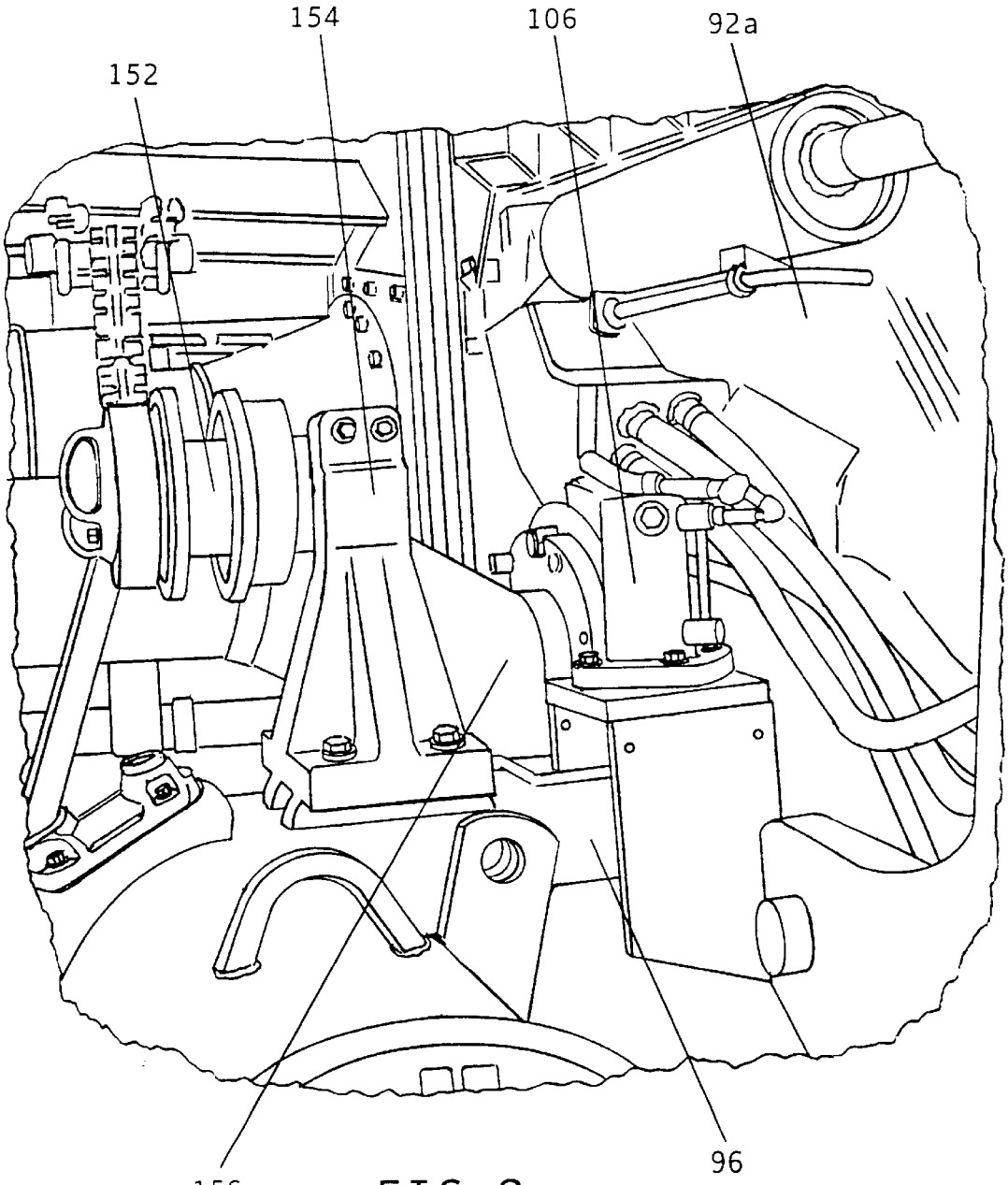
FIG. 8 is a partial perspective view showing the location of a lockout cylinder assembly mounted to a lateral portion of the vehicle's main frame and engaging an equalizer bar.

In accordance with this aspect of the present invention, first and second lockout cylinders 106 and 108 are mounted to respective sides of the tractor's main frame 92. This is also shown in the partial perspective view of FIG. 8 illustrating details of the installation of the first lockout cylinder 106 which is attached to the right side 92*a* of the vehicle's main frame and includes an extendible ram (not shown in the figure). The second lockout cylinder 108 is also provided with an extendible ram 112 as shown in FIGS. 5, 6 and 7. Extension of the first and second lockout cylinders 106,108 causes the respective rams 110 and 112 to engage an upper portion of the equalizer bar 96 preventing pivoting displacement of the equalizer bar about the pivot pin 94 connecting the equalizer bar to the tractor's main frame 92. The first and second lockout cylinders 106,108 are extended for locking the equalizer bar 96 in fixed position relative to the tractor's main frame 92 when the bulldozer/pipelayer combination is operated in a pipe laying mode. When the pipelayer mode of operation is selected by means of a mode control valve described below, the first and second lockout cylinders 106,108 extend. If the bulldozer/pipelayer combination is on level ground, the rams of both lockout cylinders 106,108 will each engage a respective end of the equalizer bar 96 so as to prevent pivoting displacement of the equalizer bar. If the bulldozer/pipelayer combination is not positioned on level ground when the two lockout cylinders 106,108 extend, the lockout cylinder adjacent the lower track frame will fully extend, but will not engage the equalizer bar, while the other lockout cylinder will engage the equalizer bar, but will not be fully extended. The latter lockout cylinder will fully extend when movement of the bulldozer/pipelayer combination causes an adjacent end of the equalizer bar to move downward because of uneven terrain. When this occurs, the former fully extended lockout cylinder will engage an adjacent end of the equalizer bar. The two fully extended lockout cylinders each engaging a respective end of the equalizer bar prevent pivoting movement of the equalizer bar. After both lockout cylinders are fully extended, lockout valves 106*a* and 108*a* respectively disposed in the first and second lockout cylinders 106 and 108 are automatically actuated by a hydraulic system described below to maintain the cylinders in the extended position. With the equalizer bar 96 and associated track frames and endless tracks locked in fixed relative position with respect to the tractor's main frame, the inventive bulldozer/pipelayer combination provides a stable platform for lifting and transporting heavy loads such as sections of pipe. The first and second lockout cylinders 106,108 are under the control of a pipelayer hydraulic system which is described in the following paragraphs.

Also shown in the perspective view of FIG. 8 are a top roller 152 for the right endless track and a roller support bracket 154 attached to the top track roller. The right lockout cylinder 106 is shown positioned adjacent the right end of the equalizer bar 96 so that its ram can engage the equalizer bar when in the pipelayer mode of operation. A support arm 156 mounted to the right side 92*a* of the tractor's main frame is attached to and supports the pipelayer's right support frame which is also not shown in the figure for simplicity.

Figure 9A:
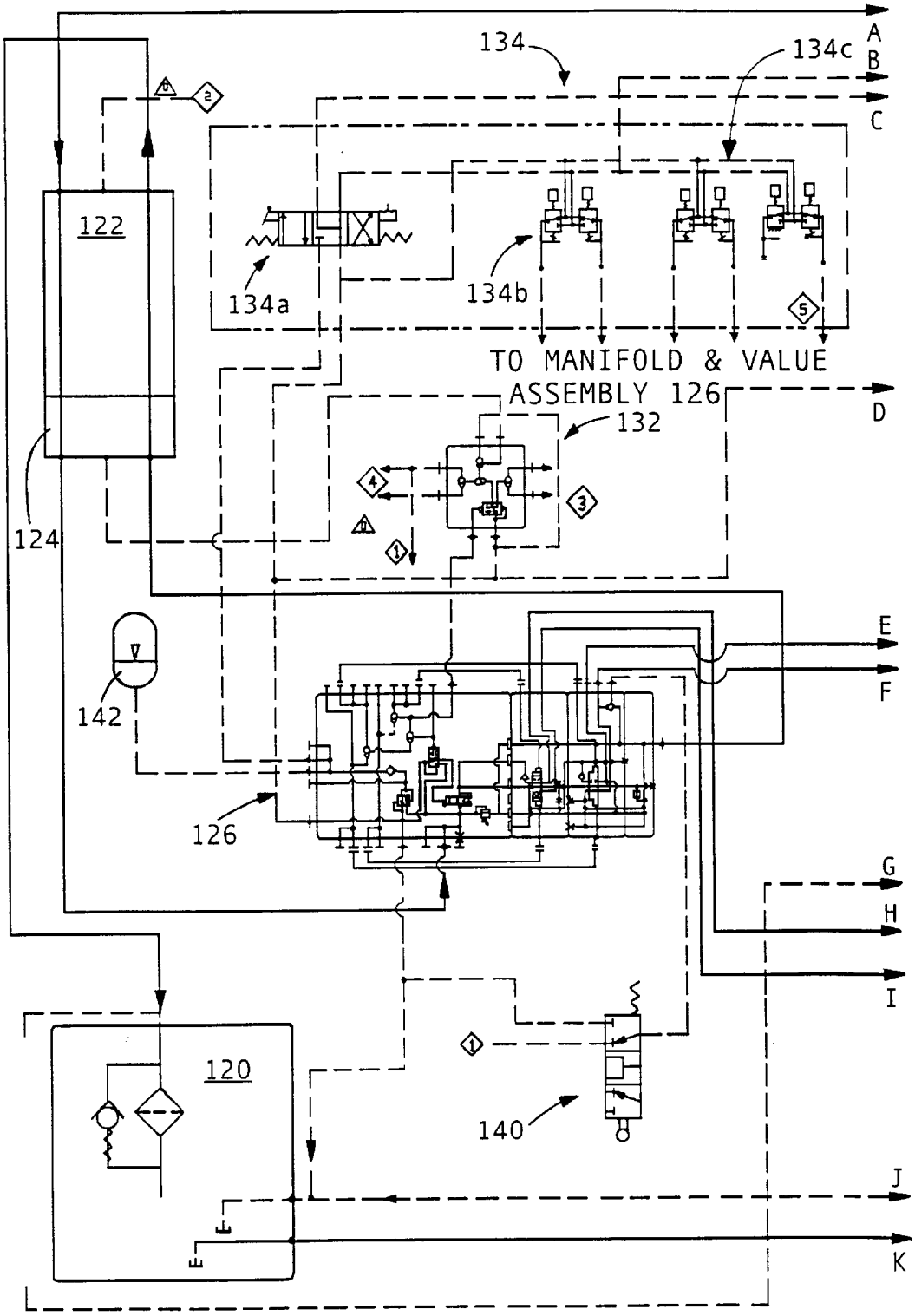
FIGS. 9*a*, 9*b* and 9*c* are a schematic diagram of the hydraulic control system used in the bulldozer/pipelayer combination of the present invention.
Figure 9B:
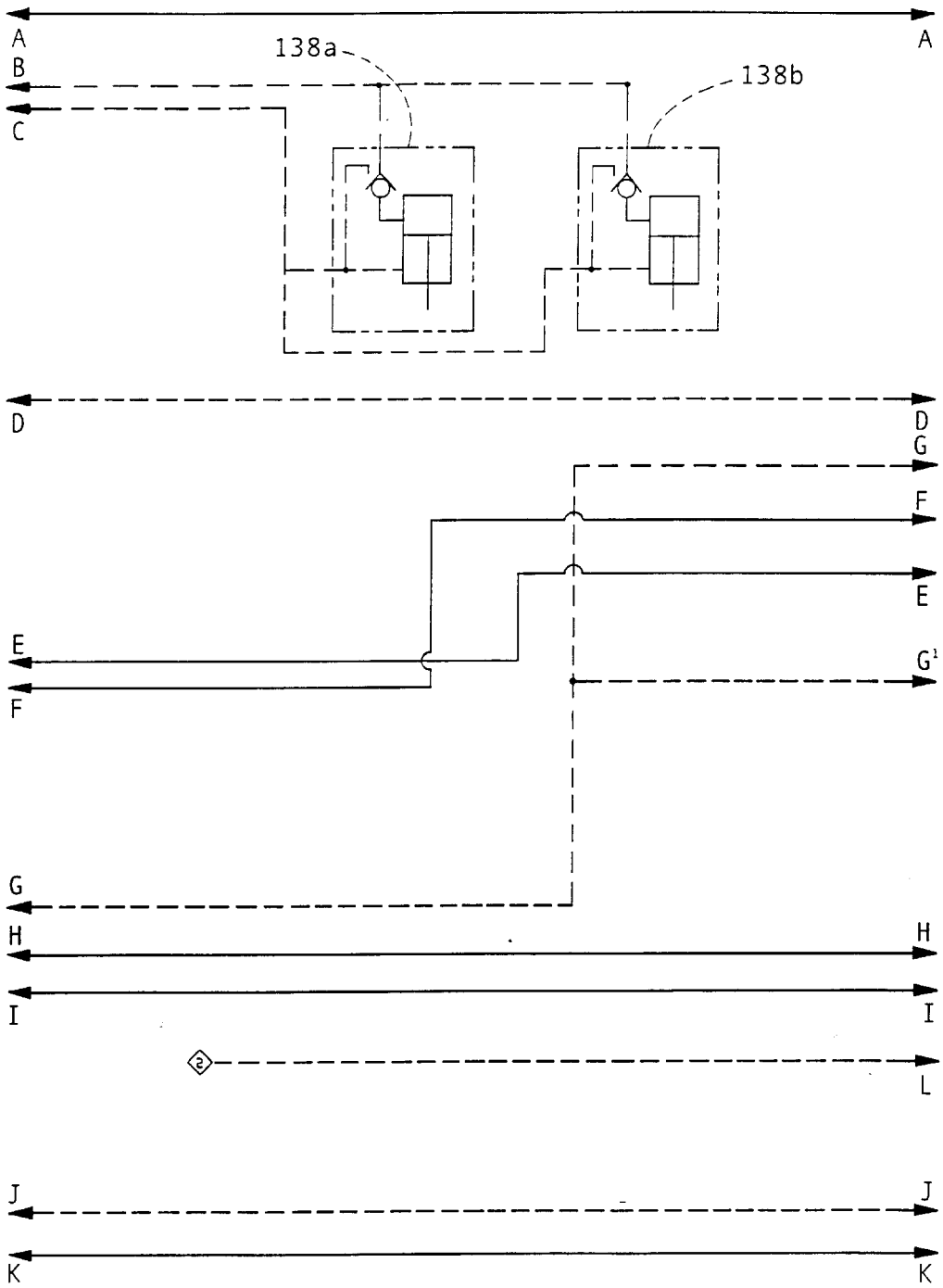
Figure 9C:
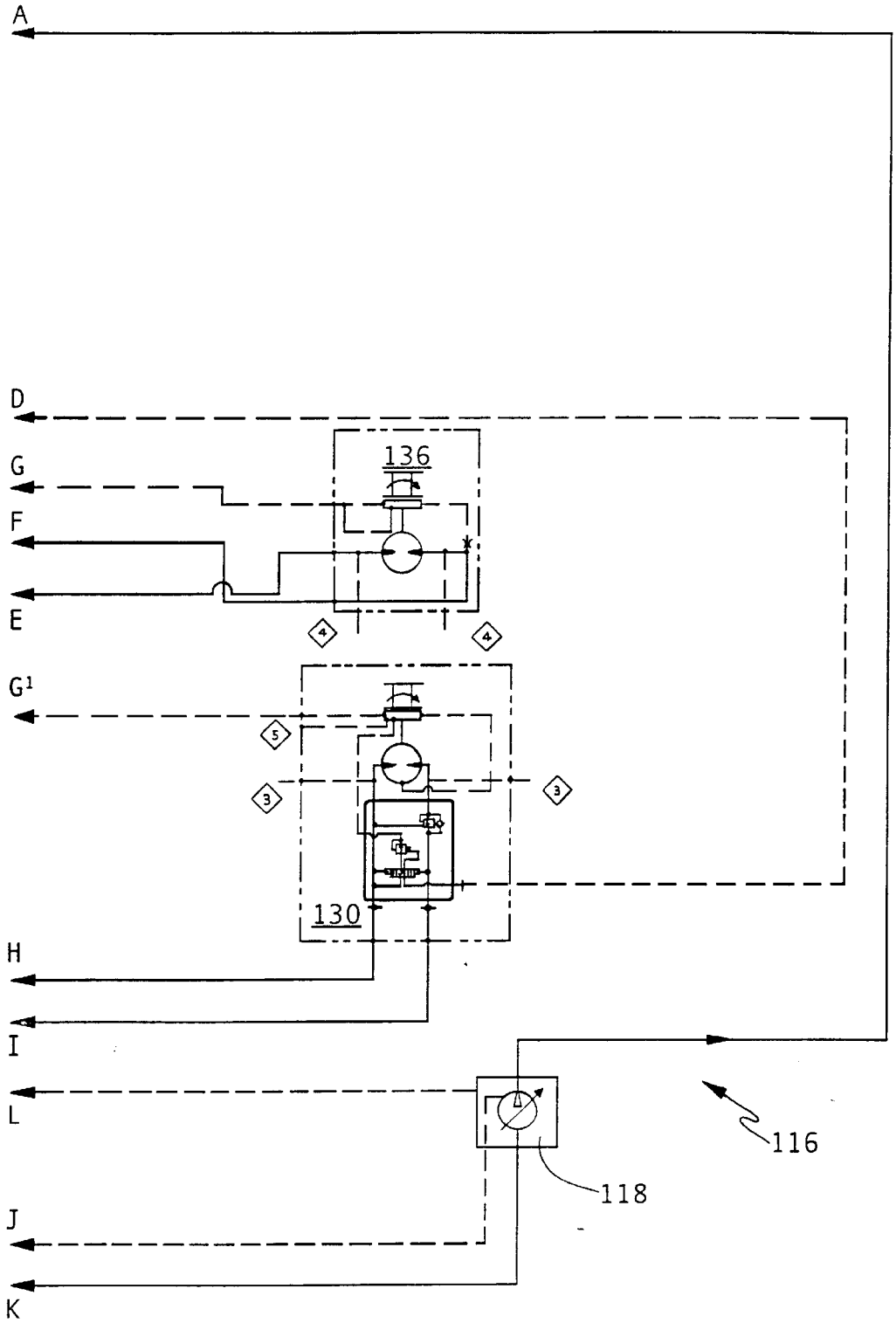

Referring to FIGS. 9*a*, 9*b* and 9*c*, there is shown a schematic diagram of a hydraulic control system 116 used in the bulldozer/pipelayer combination of the present invention for operating the pipelayer attachment. Connections between the various hydraulic lines shown in these figures are indicated by common letter designations in the several figures. The hydraulic system in a typical tractor is a parallel system wherein the flow of the hydraulic fluid is divided simultaneously between or among the various hydraulically actuated components. In this type of system, the flow is greatest in the path of least resistance, with various simultaneously actuated hydraulic components receiving different fluid flows and experiencing different levels of actuation. The hydraulic control system 116 shown in FIGS. 9*a*, 9*b* and 9*c* is a series type of system, with the hydraulic fluid flowing from first, to second, to third, etc., hydraulically actuated components. The hydraulic control system 116 is connected in series to and energized by the tractor's hydraulic system as described in detail below. In a series-type of hydraulic system, the boom and load winches operate at substantially the same speed when both are actuated providing improved load control, while in a parallel type of system the boom and load winches may operate at different speeds depending upon their respective loading. Driving the boom and load winches in series also avoids stalling out the more heavily loaded winch which can occur in a parallel hydraulic control system.

The hydraulic control system 116 is coupled in series to a pump 118 and a hydraulic reservoir or tank 120 which are part of the tractor's hydraulic system. Hydraulic pump 118 is of the variable volume, pressure compensated type. Pump 118 includes internal controls for adjusting the pump stroke to maintain a pump delivery pressure slightly larger than the signal received from the load sense connection. Hydraulic reservoir 120 is of a sealed construction with atmospheric pressure and vacuum relief and includes internal filter elements. A valve assembly 122 is connected to the hydraulic reservoir 120 and includes an inlet cover, working sections for implement control, and an end cover. The working sections within valve assembly 122 are arranged in parallel, with each section providing an indication of work port pressure for sending the highest pressure to the pump load sense connection by means of shuttle valves. A power beyond cover 124 is coupled to the valve assembly 122 for providing connections for the pipelayer hydraulic system which include a pressure line from the pump 116, a return line to the hydraulic reservoir 120, and a load sense line to a manifold assembly 132. The power beyond cover 124 also connects the pipelayer hydraulic control system 116 in series to the tractor's hydraulic system, only a portion of which is shown in the figure for simplicity. The manifold and valve assembly 126 operates the hydraulic system according to command inputs from an operator. The manifold and valve assembly 126 blocks the pump flow until a command signal is received from the operator, keeping the pump 118 at standby or in a mini-stroke mode for providing pressure. The manifold and valve assembly 126 is further coupled to an accumulator 142 as well as to a boom winch assembly 136 and a load, or hook, winch assembly 130 for controlling the up and down operation of the boom and hook. The manifold and valve assembly 126 further limits pressure to the accumulator 142 and a pilot control system 134. The accumulator 142 functions as a short term, standby pressure source and serves to maintain a more constant pressure for the pilot control system. The hook winch assembly 130 reduces brake release pressure, allows for brake release only when the hook control is in the down position, and includes a counter balance valve to control hook down loads. The boom winch assembly 136 controls the raising and lowering of the boom.

A manifold assembly 132 receives inputs from the hook and boom winch assemblies 130,136. The higher pressure from one of these two assemblies is selected and is provided to a load sense connection in the power beyond cover 124 coupled to the valve assembly 122. The pilot control system 134 includes various operator controls such as a bulldozer/pipelayer mode control valve 134*a* which is connected to lockout cylinders 138*a* and 138*b* for locking the track roller frames in fixed position on the main frame as previously described. When in the bulldozer mode of operation, the mode control valve 134*a* deprives first and second remote hydraulic control switches 134*b* and 134*c* of oil so that the valve spools of the manifold and valve assembly 126 cannot shift so as to lock the hook and boom winches by means of the respective winch brakes. The bulldozer/pipelayer mode control valve 134*a* also unlocks the hook and boom winch assemblies 130,136 for permitting pipelayer operation when in the pipelayer mode. Operator controls 134 further include first and second remote hydraulic control switches 134*b* and 134*c*. The first remote control switch 134*b* shifts a pilot operated valve section (not shown) to raise or lower the boom. The second remote control switch 134*c* shifts the pilot operated valve section to raise or lower the hook and to also activate the winch quick drop valve. A boom stop valve 140 is coupled to the manifold and valve assembly 126 for limiting upward displacement of the boom and preventing over rotation of the boom.

Figure 10A:
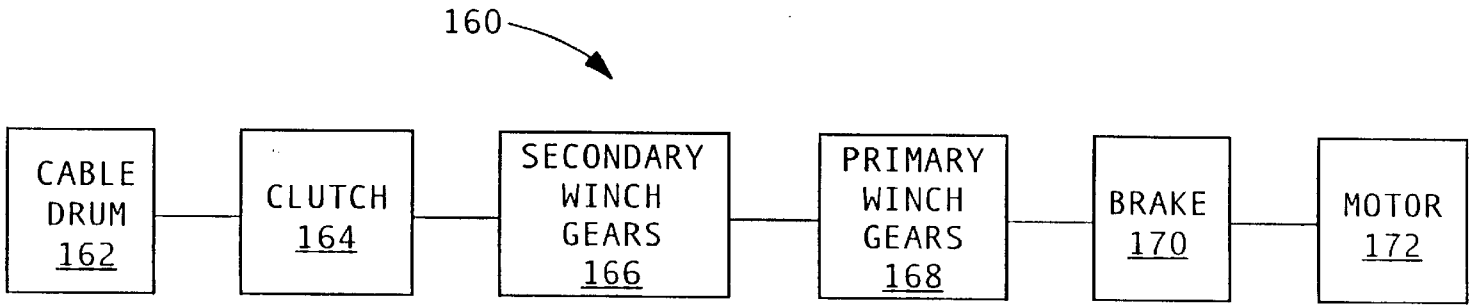
FIG. 10a (PRIOR ART)
FIG. 10*a* is a simplified block diagram of a prior art load winch drive train such as used in a conventional pipelayer.

Referring to FIG. 10*a*, there is shown a simplified block diagram of a prior art load winch drive train 160 such as used in a conventional pipelayer. The load winch drive train 160 includes a cable drum 162 coupled to a free fall clutch 164 which, in turn, is connected to winch gears including secondary winch gears 166 and primary winch gears 168. The primary winch gears 168 are connected to a winch drive motor 172 by means of a brake 170. In the prior art load winch drive train 160, a free fall feature is incorporated to disengage a load in the case of a dangerous or emergency situation such as when the stability of the pipelayer is lost. This would typically occur when lifting a heavy load and either the position of the boom or the orientation of the pipelayer apparatus presents an unstable situation. When an unstable situation is detected, the clutch 164 in the prior art load winch drive train 160 disconnects the cable drum 162 from the entire drive train including the secondary and primary winch gears 166, 168 as well as from the brake 170 and drive motor 172.

Figure 10B:
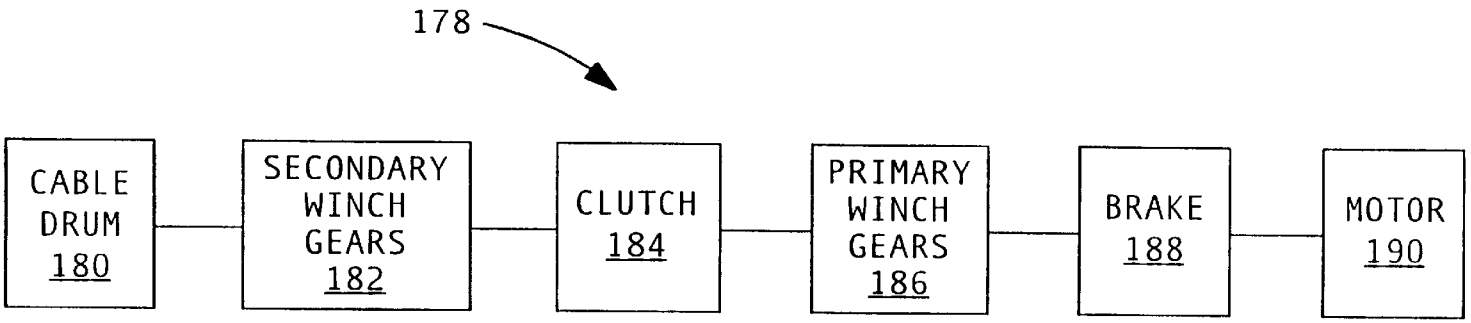
FIG. 10*b* is a simplified block diagram of a load winch drive train incorporated in a pipelayer in accordance with the present invention.

Referring to FIG. 10*b*, there is shown a simplified block diagram of a load winch drive train 178 incorporated in a pipelayer in accordance with the present invention. The inventive load winch drive train 178 includes a cable drum 180 connected to a quick drop clutch 184 via secondary winch gears 182. The clutch 184 is, in turn, connected to the drive motor 190 via the combination of primary winch gears 186 and a brake 188. In the event an unstable condition of the pipelayer is sensed, the clutch 184 does not disconnect the secondary winch gears 182 from the cable drum 180, but rather only disconnects the primary winch gears 186, the brake 188 and the motor 190 from the secondary winch gears in allowing the load to fall under its own weight. By disengaging only the primary winch gears 186 rather than the combination of the primary winch gears and the secondary winch gears 182 from the cable drum 180, the quick drop clutch 184 in the inventive load winch drive train 178 provides a simpler, less expensive arrangement for enabling the quick drop release of a suspended load. The release of a suspended load by the inventive load winch drive train 178 is accomplished by disconnecting the cable drum 180 from only a portion of the drive train rather than from the entire drive train allowing the suspended load to drop as described in detail in the following paragraph.

Figure 11:
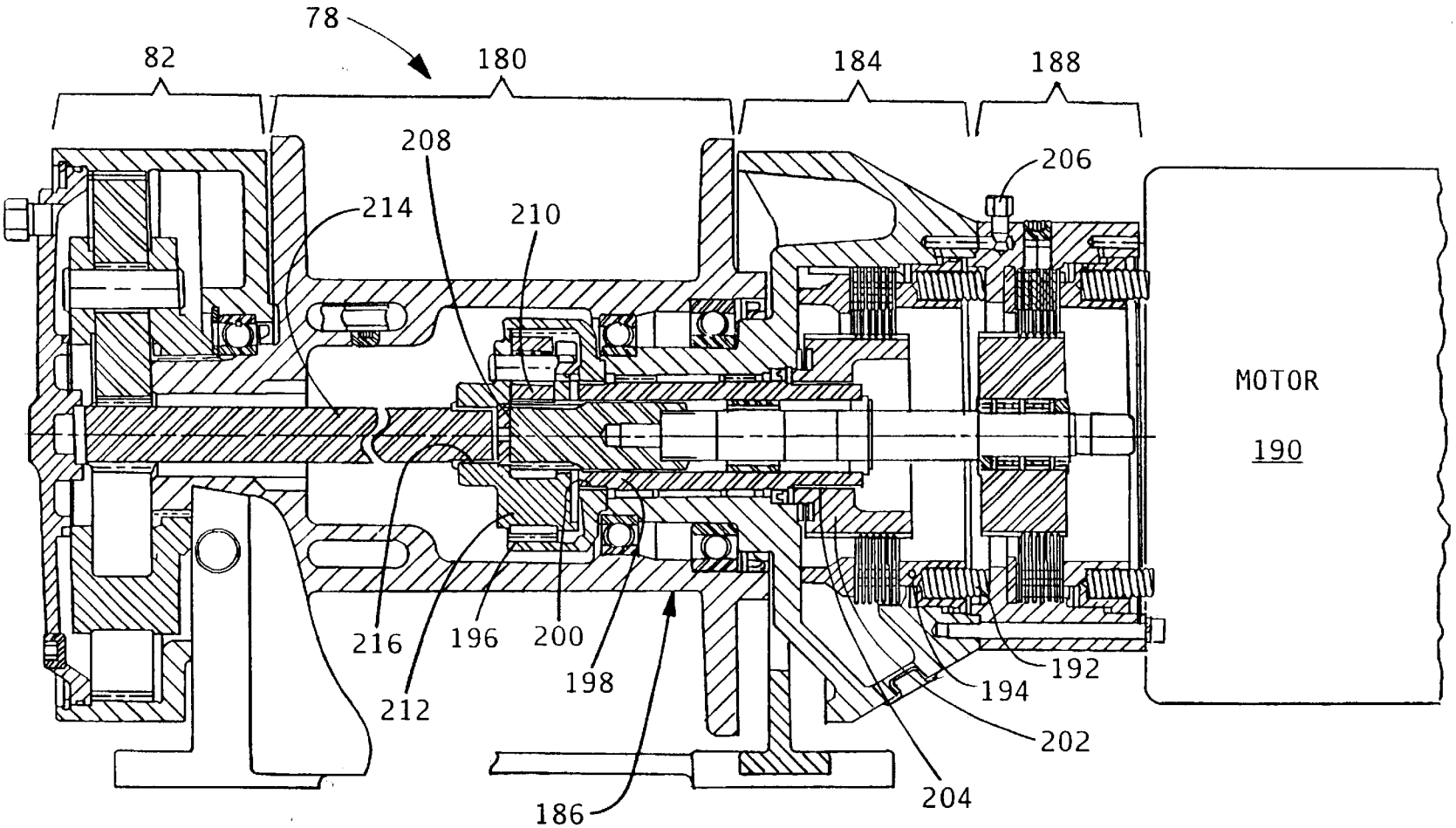
FIG. 11 is a longitudinal sectional view of the inventive load winch drive train shown in FIG. 10*b* in a simplified block diagram form.

Referring to FIG. 11, there is shown a longitudinal sectional view of the inventive load winch drive train 178 which is shown in FIG. 10*b* in simplified block diagram form. When the quick drop mode of operation is actuated, hydraulic fluid, or oil, enters the clutch 184 via an oil inlet adapter 206. The oil causes a piston 194 in the quick drop clutch 184 to move to the right as viewed in FIG. 11. Rightward movement of piston 194 causes the piston to press against a series of springs 192 resulting in release of the multi-disc clutch 184. More specifically, rightward displacement of the piston 194 allows a hub 202, a connecting shaft 198, and an internal gear 196 to turn freely as a unit. With the internal gear 196 turning freely, no effective torque is transmitted through primary planet gears 210 to a primary sungear 208. No effective torque is also transmitted through the primary sungear 208 to a primary planet hub 212. The primary planet hub 212 is splined to a sungear 214 by means of a rotor clip 216. Thus, when the clutch 184 is released, the final planet assembly rotates with the cable drum 180 around the stationary sungear 214. By disengaging the clutch 184, the cable drum 180 and the secondary winch gears 182 are uncoupled from the primary drive gears 186 (which include the planetary gear 210, the internal gear 196, and sungear 208), the motor 190, and the winch brake 188. With the clutch 184 disengaged, a load suspended from a cable (not shown) wrapped around the cable drum 180 will drop under its own weight.

There has thus been shown a combination bulldozer and pipelayer having a front mounted earth moving attachment such as a blade or bucket and a side mounted pipelayer attachment for lifting and positioning sections of pipe. A pair of endless track roller frames are mounted to respective sides of the vehicle's main frame and are free to oscillate up and down about a horizontal axis passing through the main frame when operated as a bulldozer for improved traction and grading characteristics. The vertically oscillating track roller frames transmit ground impact loads directly to the main frame and provide a more comfortable ride for the operator when in the bulldozing mode of operation. In the pipelayer mode of operation, the track roller frames are locked in fixed position on the main frame and prevented from oscillating to provide a stable platform for lifting and transporting heavy loads such as sections of pipe. The side mounted pipelayer attachment includes a multi-section folding boom which can be stowed in a retracted position in closely spaced relation to a side and the top of the vehicle and can also be extended to the use position for lifting heavy loads using the pipelayer winch controls with minimal manual effort. When the boom is retracted in closely spaced relation to the vehicle, the vehicle may be operated in narrow, low spaces as a bulldozer without removing the boom. The close fitting relation of the folded boom to the vehicle also reduces the likelihood of impact damage to the boom when the vehicle is operated in the bulldozer mode and also during shipping. The vehicle's hydraulic system is connected in series to the pipelayer's series hydraulic system to permit operation of the pipelayer boom and load winches at the same speed for improved load control without stalling the heavier loaded winch drum.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A bulldozer/pipelayer apparatus including a main frame with an engine and a ground engaging attachment disposed on a forward portion of said main frame for engaging and displacing soil or heavy objects when used in a bulldozer mode of operation, and a pipelayer attachment including a boom and boom and load winches for lifting and transporting sections of pipe when used in a pipelayer mode of operation, said apparatus comprising:

right and left side frames each having a respective drive means attached thereto and engaging the ground for propelling the apparatus in a direction of travel, wherein said right and left side frames are attached to respective lateral portions of the main frame and are free to oscillate vertically as the apparatus traverses irregular terrain when in the bulldozer mode of operation and wherein the boom is pivotally mounted to only one of said side frames and extends transversely to the direction of travel;

an equalizer bar having first and second opposed ends and a center portion, wherein said equalizer bar is pivotally coupled to the main frame and the first and second ends of said equalizer bar are respectively coupled to said right and left side frames;

releasable locking means mounted to said main frame and engaging said equalizer bar when in the pipelayer mode of operation for preventing vertical oscillation of said side frames to provide stability for lifting and transporting sections of pipe and for releasing said equalizer bar and allowing vertical oscillation of said side frames when in the bulldozer mode of operation, wherein said locking means includes first and second hydraulic cylinders each having an extendible ram for engaging said equalizer bar for limiting vertical oscillation of said side frames when lifting and transporting sections of pipe over irregular terrain and maintaining said equalizer bar level while preventing vertical oscillation of said side frames when the bulldozer/pipelayer apparatus traverses level ground; and operator responsive input means for selecting either the pipelayer mode of operation, wherein said equalizer bar is prevented from vertical oscillation and said boom and load winches are automatically rendered operable, or the bulldozer mode of operation, wherein said equalizer bar is free to oscillate vertically and said boom and load winches are automatically locked.

2. The apparatus of claim 1 further comprising first pivoting coupling means for connecting the center portion of said equalizer bar to the main frame and allowing the first and second ends of said equalizer bar to move vertically in an oscillating manner.

3. The apparatus of claim 2 wherein said equalizer bar is coupled to a lower portion of the main frame and is aligned longitudinally generally transverse to a direction of travel of the apparatus.

4. The apparatus of claim 3 further comprising second and third pivoting coupling means for connecting the first and second ends of said equalizer bar respectively to said right and left side frames.

5. The apparatus of claim 4 wherein said first, second and third pivoting coupling means each includes a respective pivot pin.

6. The apparatus of claim 1 further comprising a hydraulic control system coupled to said hydraulic cylinders.

7. The apparatus of claim 6 wherein the rams of each of said hydraulic cylinders are extended for engaging said equalizer bar when in the pipelayer mode of operation and are retracted when in the bulldozer mode of operation.

8. The apparatus of claim 1 wherein said operator responsive input means includes a mode control valve in said hydraulic control system coupled to the boom and load winches for locking the winches when in the bulldozer mode of operation.

* * * * *